US005108458A

United States Patent [19]

Marumoto et al.

[11] Patent Number: 5,108,458

[45] Date of Patent: Apr. 28, 1992

[54] SIZING AGENT FOR CARBON FIBER

[75] Inventors: Motoi Marumoto; Yojiro Hara; Tadanori Kitamura, all of Fukushima, Japan

[73] Assignees: Nitto Boseki Co., Ltd., Fukushima; Kawasaki Steel Corporation, Kobe City, both of Japan

[21] Appl. No.: 262,791

[22] Filed: Oct. 26, 1988

[30] Foreign Application Priority Data

Oct. 29, 1987 [JP] Japan ..... 62-273926
Oct. 11, 1988 [JP] Japan ..... 63-255601

[51] Int. Cl.[5] ..... D06M 15/00

[52] U.S. Cl. ..... 8/115.6; 8/115.51; 423/447.1; 423/447.2

[58] Field of Search ..... 8/115.6; 423/447.1, 423/447.2; 252/8.6

[56] References Cited

U.S. PATENT DOCUMENTS 4,009,305 2/1977 Fujimaki et al. ..... 8/115.6
4,433,017 2/1984 Goto et al. ..... 8/115.6
4,606,808 8/1986 Yamada et al. ..... 423/447.1

FOREIGN PATENT DOCUMENTS 0256852 2/1988 European Pat. Off. .
1148873 4/1969 United Kingdom .

*Primary Examiner*—Prince Willis, Jr.
*Assistant Examiner*—John F. McNally
*Attorney, Agent, or Firm*—Wegner, Cantor, Mueller & Player

[57] ABSTRACT

This invention provides a sizing agent for carbon fiber which contains an isocyanate regenerating compound which is an isocyanate compound, the —NCO group of which is stabilized with a blocking agent. Further provided are carbon fiber improved in adhesion to resins and carbon fiber reinforced composite materials improved in various properties such as tensile strength, flexural strength and Izod impact strength.

9 Claims, No Drawings

SIZING AGENT FOR CARBON FIBER

BACKGROUND OF THE INVENTION

The present invention relates to a sizing, agent for carbon fibers and more particularly to a sizing agent for carbon fibers which contains an isocyanate regenerating compound. According to the present invention, there are provided sizing agents which can improve various properties of carbon fiber reinforced composite materials and carbon fibers which are improved in bonding to resins.

Carbon fibers are combined with resins and the composites are widely used in various fields such as aircrafts, automobiles, ships, sports goods and the like.

Normally, these carbon fibers are subjected to surface treatment in order to improve adhesion to matrix resins to afford excellent performances as composite materials.

For the surface treatment, generally, the surface of carbon fibers is oxidized and then sized with an epoxy resin (Japanese Patent Kokai No. 61-252371). It is further proposed to use as a sizing agent a mixture of epoxy resin and polyurethane resin (Japanese Patent Kokai No. 62-110984) and a polyurethane resin (Japanese Patent Kokai No. 58-126375).

In order to make the best use of the excellent properties of carbon fibers in composite with resins, it is necessary to enhance the bonding between carbon fiber and matrix resin. For this purpose, various sizing agents have been used and it is said that carbon fiber coated with polyurethane resin is effective. (Japanese Patent Kokai No. 58-126375). However, this method is still insufficient in utilization of performance of carbon fiber.

SUMMARY OF THE INVENTION

As a result of the inventors' intensive research on development of sizing agents which are superior in compatibility with and adhesion to matrix resin and sufficient in bonding to carbon fiber and can provide excellent properties of carbon fiber composite materials, especially interlaminar shear strength, the sizing agents of the present invention have been found.

That is, an object of the present invention is to provide such superior sizing agents.

Another object of the present invention is to provide carbon fiber improved in bonding to resin.

DESCRIPTION OF THE INVENTION

The objects of the present invention can be attained by coating the surface of carbon fiber with an isocyanate compound, an —NCO group of which is stabilized with a blocking agent (hereinafter referred to as "isocyanate regenerating compound" which regenerates an —NCO group by heating). The inventors have found that when a specific isocyanate regenerating compound formed by stabilizing a isocyanate compound with an blocking agent is added to a sizing agent, the specific isocyanate regenerating compound is present as it is on the fiber even after drying the sizing agent applied onto carbon fiber and when heating temperature in case of molding the carbon fiber together with a matrix resin is higher than the decomposition temperature of the isocyanate regenerating compound, the —NCO group regenerated at the boundary surface between the carbon fiber and the matrix resin further strengthens bonding between the fiber and the resin. The present invention has been made based on this finding.

The isocyanate compounds used in the present invention include polyurethane resin prepolymers prepared so as to contain an unreacted —NCO group such as, for example, methylene diisocyanate, hexamethylene diisocyanate, tolylene diisocyanate, xylylene diisocyanate, diphenylmethane diisocyanate, and dicyclohexylmethane diisocyanate. Since the —NCO group of these isocyanate compounds easily reacts with a compound having an active hydrogen, they are often used as a cross-linking agent for polymer compounds. However, in case these compounds are allowed to adhere to the surface of carbon fiber and the carbon fiber is mixed with resin as in the present invention, they are seldom used immediately after preparation thereof and in many cases they are used after being stored for a certain period. Therefore, —NCO groups high in reactivity may react with water in the air to lose their effects. In this connection, it is also advantageous to use isocyanate compounds stabilized by reacting —NCO group with a blocking agent. As the blocking agent, known ones may be used and especially preferred are phenols, diethyl malonate esters, acetoacetate esters, acetyl acetone, ε-caprolactam, methyl ethyl ketoxime and bis-4,4-ethyleneurea.

The isocyanate regenerating compounds stabilized with these blocking agents do not decompose at 80°-120° C. which is the drying temperature for the sizing agent and decompose at a temperature equal to or lower than the temperature for blending with resin and molding it to regenerate the active —NCO group.

It is essential that the sizing agent of the present invention contains the isocyanate regenerating compound having an —NCO group stabilized with a blocking agent. The isocyanate regenerating compound alone has a satisfactory effect as sizing agent, but when continuous long fiber strands are treated, further superior effects are exhibited for promoting bundling of filaments and spreading of the isocyanate regenerating compound onto the surface of the carbon fiber if it is used in combination with known high polymer sizing agents. Preferred known sizing agents include, for example, epoxy resin, polyurethane resin, acrylic resin, polystyrene resin and vinyl acetate resin.

The blending ratio of solid matter of sizing agent other than isocyanate regenerating compound/isocyanate regenerating compound is normally 0/1-100/1, preferably 0/1-20/1. The desired effect can be obtained by treatment of carbon fiber with only the isocyanate regenerating compound. When the proportion of solid content of sizing agent other than isocyanate regenerating compound is more than 100 times the content of isocyanate regenerating compound, the amount of isocyanate regenerating compound which adheres to carbon fiber decreases and the strength enhancing effect on composite material made from the carbon fiber decreases. Method for preparation of sizing agent include, for example, a method of dispersing and dissolving the above components in known solvents such as amides, ketones, cellosolves and halogenated hydrocarbons and a method of dispersing them in water for improvement and safety in working atmosphere and for reduction of total cost.

The organic solvents used include, for example, dimethyl formamide, acetone, methyl ethyl ketone, methyl cellosolve and perchloroethylene. The water dispersion type sizing agent can be obtained by dispersing the components in water by usual means with addition of a nonionic surface active agent such as polyoxyethylenealkyl ether in an amount of 1-20 parts by weight to 100 parts by weight of sizing agent (solid content).

Amount of sizing agent adhering to the surface of carbon fiber is adjusted between 0.01-20% by weight. When the amount is less than 0.01% by weight, strength enhancing effect cannot be attained. Preferred range is 0.1-5.0% by weight. However, the adhering amount may vary depending on use of carbon fiber and, for example, when the carbon fiber is made into composite material and strength as composite material and high bundling property of carbon fiber bundle are both required, it is necessary to allow sizing agent to adhere in a large amount. Even in this case, more than 20% by weight of sizing agent is not needed to adhere to carbon fiber.

Amount of isocyanate regenerating compound in solid content of sizing agent adhering to the surface of carbon fiber is 0.01-2.0% by weight, preferably 0.02-1.0% by weight of carbon fiber. If the amount is less than 0.01% by weight, no effect is exhibited and if more than 2.0% by weight, the effect no longer increases.

The sizing agent of the present invention prepared by a suitable method mentioned above is allowed to adhere to carbon fiber by an ordinary method such as dipping, roller sizing, spraying or the like and then is dried.

The carbon fiber to which the sizing agent is to be applied may be not only in the form of continuous long fiber or short cut chopped strands, but also in the form of finished products such as woven fabric, mat, sheet or felt.

The carbon fiber thus surface treated with sizing agent is combined with thermoplastic resins such as polyacetal resin, polyphenylene sulfide resin and polyamide resin and thermosetting resins such as phenolic resin, polyester resin and furan resin. The effect of the sizing agent is conspicuous when polyphenylene sulfide resin or polyacetal resin is used as a matrix resin.

It is considered that tee isocyanate regenerating compound contained in the sizing agent of the present invention regenerates an —NCO group by the heating at molding with resins, which reacts with the —OH group present mostly on the surface of general-purpose carbon fiber, or the —COOH group or the —OH group group on the surface of oxidation-treated carbon fiber or graphite fiber to produce a urethane bond and especially when the matrix resin is, for example, a polyacetal resin, hydrogen of methylene group in the polyacetal bonds to —NCO group. In this way, the —NCO group regenerated by heating forms a strong bond between carbon fiber and matrix resin through the sizing agent and thereby a composite material which possesses the excellent properties of carbon fiber can be obtained.

The present invention will be explained in more detail by the following examples.

EXAMPLE 1

Diphenylmethane diisocyanate stabilized with ε-caprolactam was used as isocyanate regenerating compound. One part by weight of this isocyanate regenerating compound and 14 parts by weight of polyurethane resin were dissolved in methyl ethyl ketone so as to reach a concentration of 1.0% by weight. Thus, a sizing agent was prepared. In this solution was dipped coal pitch carbon fiber chopped strands (tensile strength: 100 kg/mm$^2$, fiber length: 3 mm and fiber diameter: 12μ; manufactured by Nitto Boseki Co., Ltd.) and taken out therefrom and dried with hot air of 70° C. Amount of the sizing agent adhering to carbon fiber was 1.2% by weight.

Five samples of chopped strands were prepared by the same treatment as above with sizing agents changed in concentration of sizing agent and ratio of polyurethane resin and isocyanate regenerating compound. (Examples 1—1 ~ 1-5). Each of these carbon fiber chopped strands was added in an amount of 20% by weight to polyacetal resin (Duracon manufactured by Polyplastics Co.) and the mixture was extrusion molded by a vent extruder with a screw diameter of 60 m/m at a cylinder temperature of 240° C. to obtain chips of carbon fiber reinforced polyacetal resin. The chips were dried and molded into a test piece by injection molding machine. The resulting test piece was tested on properties. The results are shown in Table 1.

COMPARATIVE EXAMPLE 1

Molding materials were prepared from the same carbon fiber chopped strands as used in Example 1 which had been subjected to no surface treatment (Comparative Example 1—1) or which had been subjected to the same treatment as in Example 1 with a sizing agent composed of only polyurethane resin (i.e., containing no isocyanate regenerating compound) (Comparative Example 1-2) and from polyacrylonitrile carbon fiber (tensile strength: 200 kg/mm$^2$ and tensile modulus: 15 ton/mm$^2$) for molding with polyacetal resin to which epoxy resin was allowed to adhere (Comparative Example 1-3). These molding materials were sufficiently dried and molded into test pieces by injection molding machine. They were tested on properties. The results are also shown in Table 1.

TABLE 1

| Example No. | Polyurethane resin/ isocyanate regenerating compound (weight ratio) | Adhering amount (% by weight per carbon fiber) | Tensile strength (kg/cm$^2$) | Flexural strength (kg/cm$^2$) | Izod value (notched) (kg · cm/cm) |
|---|---|---|---|---|---|
| 1-1 | 0/1 | 0.3 | 1050 | 1730 | 5.4 |
| 1-2 | 1/1 | 1.2 | 1070 | 1710 | 5.0 |
| 1-3 | 1/1 | 0.2 | 1080 | 1750 | 5.2 |
| 1-4 | 9/1 | 0.6 | 1020 | 1780 | 5.1 |
| 1-5 | 14/1 | 1.2 | 1010 | 1830 | 5.1 |
| Com. Ex. | | | | | |
| 1-1 | 0/1 | 0 | 870 | 1530 | 4.4 |
| 1-2 | 1/0 | 1.3 | 950 | 1650 | 4.4 |
| 1-3 | PAN* | 6.3 | 780 | 1330 | 4.3 |

*Polyacrylonitrile carbon fiber treated with epoxy resin type sizing agent, for molding with polyacetal resin.

EXAMPLE 2

Carbon fiber chopped strands to which 1.2% by weight of a sizing agent having a weight ratio of polyurethane resin/isocyanate regenerating compound of 14/1 was allowed to adhere were prepared in the same manner as in Example 1. In the same manner as in Example 1, from this chopped strand was made a test piece of polyphenylene sulfide resin (Ryton R-6 manufactured by Phillips Petroleum Co.) containing 30% by weight of carbon fiber. This test piece was tested on properties. The results are shown in Table 2.

COMPARATIVE EXAMPLE 2

The same test pieces as prepared in Example 2 containing 30% by weight of carbon fiber were prepared using carbon fiber chopped strands subjected to no sizing treatment (Comparative Example 2-1) and carbon fiber chopped strands treated in the same manner as in Example 1 with polyurethane resin sizing agent containing no isocyanate regenerating compound (Comparative Example 2—2). The results are also shown in Table 2.

TABLE 2

| Example No. | Polyurethane resin/ isocyanate regenerating compound (weight ratio) | Adhering amount (% by weight per carbon fiber) | Tensile strength ($kg/cm^2$) | Flexural strength ($kg/cm^2$) | Izod value (notched) (kg · cm/cm) |
|---|---|---|---|---|---|
| 2 | 14/1 | 1.2 | 1450 | 1880 | 4.5 |
| Com. Ex. | | | | | |
| 2-1 | 1/0 | 1.3 | 1250 | 1550 | 4.2 |
| 2-2 | 0/0 | 0 | 900 | 1270 | 4.0 |

EXAMPLE 3

Sizing agents having epoxy resin/isocyanate regenerating compound of 1/1 and 9/1 were prepared in the same manner as described in Example 1 except that epoxy resin was used in place of polyurethane resin. In the same manner as in Example 1, carbon fiber chopped strands of 1.0% by weight in adhering amount of the sizing agent were prepared by treating them with the above sizing agents. (Examples 3-1 and 3-2).

Test pieces were prepared from these carbon fiber chopped strands in the same manner as in Example 1. Properties of the test pieces were tested. The results are shown in Table 3.

COMPARATIVE EXAMPLE 3

The same carbon fiber chopped strands as used in Example 1 was treated with epoxy resin sizing agent containing no isocyanate regenerating compound. Test piece was prepared from the chopped strands in the same manner as in Example 1. Properties of the test piece was tested. The results are also shown in Table 3.

TABLE 3

| Example No. | Epoxy resin/ isocyanate regenerating compound (weight ratio) | Adhering amount (% by weight per carbon fiber) | Tensile strength ($kg/cm^2$) | Flexural strength ($kg/cm^2$) | Izod value (notched) (kg · cm/cm) |
|---|---|---|---|---|---|
| 3-1 | 1/1 | 1.0 | 1070 | 1670 | 4.6 |
| 3-2 | 9/1 | 1.0 | 1000 | 1650 | 4.6 |
| Com. Ex. 3 | 1/0 | 1.0 | 900 | 1550 | 4.3 |

EXAMPLE 4

Hexamethylene diisocyanate stabilized with ε-caprolactam, diphenylmethane diisocyanate stabilized with methyl ethyl ketoxime and diphenylmethane diisocyanate stabilized with bis-4,4-ethyleneurea were used as isocyanate regenerating compound in this example. An aqueous solution containing 1 part by weight of the isocyanate regenerating compound and 6% by weight (solid content) of urethane resin emulsion was prepared and the same chopped strands as used in Example 1 was dipped in this aqueous solution and dried in a hot air oven at 110° C. after dewatering. Amount of sizing agent adhering to carbon fiber was adjusted to 0.9% by weight.

The thus treated chopped strands were added in an amount of 20% by weight to polyacetal resin and the mixture was molded in the same manner as in Example 1. Properties of the molded test piece were measured. The results are shown in Table 4.

TABLE 4

| Example No. | Polyurethane resin/ isocyanate regenerating compound (weight ratio) | Adhering amount (% by weight per carbon fiber) | Tensile strength ($kg/cm^2$) | Flexural strength ($kg/cm^2$) | Izod value (notched) (kg · cm/cm) |
|---|---|---|---|---|---|
| 4-1 | 6/1 | 0.9 | 1020 | 1760 | 4.4 |
| 4-2 | 6/1 | 0.9 | 1010 | 1730 | 4.4 |
| 4-3 | 6/1 | 0.9 | 1000 | 1730 | 4.3 |

Kind of isocyanate regenerating compound:

Example 4-1: ε-caprolactam stabilized hexamethylene diisocyanate

Example 4-2: Methyl ethyl ketoxime stabilized diphenylmethane diisocyanate

Example 4-3: Bis-4,4-ethyleneurea stabilized diphenylmethane diisocyanate

As is clear the results as shown in Table 1, 2, 3 and 4, bonding between carbon fiber and resin is enhanced by using carbon fiber treated with sizing agents containing the isocyanate regenerating compound and there can be obtained molded articles superior to those obtained by conventional methods in all of tensile strength, flexural strength and Izod impact strength.

What is claimed is:

1. A sizing agent for carbon fiber used in producing a carbon fiber-reinforced composite comprising an isocyanate regenerating compound selected from the group consisting of methylene diisocyante, hexamethylene diisocyanate, tolylene diisocyante, xylylene diisocyanate, diphenylmethane diisocyanate, and dicyclohexylmethane diisocyante having —NCO groups stabilized with a blocking agent selected from the group consisting of phenol, diethyl malonate, acetoacetate, acetylacetone, ϵ-caprolactam, methyl ethyl ketoxime and bis-4,4-ethyleneurea; and a high polymer material selected from the group consisting of epoxy resin, polyurethane resin, polystyrene resin, acrylic resin, polystyrene resin and vinyl acetate resin.

2. Carbon fiber treated with a sizing agent comprising an isocyanate regenerating compound selected from the group consisting of methylene diisocyanate, hexamethylene diisocyanate, tolylene diisocyanate, xylylene diisocyanate, diphenylmethane, and dicyclohexylmethane diisocyanate having —NCO groups stabilized with a blocking agent selected from the group consisting of phenol, diethyl malonate, acetoacetate, acetylacetone, ϵ-caparolactam, methyl ethyl ketoxime, and bis-4,4-ethyleneurea.

3. A carbon fiber according to claim 2 wherein weight ratio of isocyanate regenerating compound to other sizing material in the sizing agent is 1/0–1/100.

4. A method for surface treatment of carbon fiber for producing a carbon-fiber-reinforced compound which comprises treating carbon fiber with a sizing agent comprising an isocyanate regenerating compound selected from the group consisting of methylene diisocyanate, hexamethylene diisocyanate, tolylene diisocyanate, xylylene diisocyanate, diphenylmethane, and dicyclohexylmethane diisocyanate having —NCO groups stabilized with a blocking agent selected from the group of phenol, diethyl malonate, acetoacetate, acetylacetone, ϵ-caparolactam, methyl ethyl ketoxime, and bis-4,4-ethyleneurea to allow the sizing agent to adhere to the surface of the carbon fiber at a temperature not decomposing the sizing agent.

5. A method according to claim 4 wherein ratio of isocyanate regenerating compound to other sizing material in the sizing agent is 1/0–1/100.

6. A method according to claim 4 wherein the sizing agent further comprises a material selected from the group consisting of epoxy resin, polyurethane resin, acrylic resin, polystyrene resin and vinyl acetate resin.

7. A method according to claim 4 wherein amount of sizing agent adhering to the surface of the carbon fiber is 0.01–20% by weight of the carbon fiber.

8. A method according to claim 4 wherein amount of the isocyanate regenerating compound adhering to the surface of the carbon fiber is 0.01–2.0% by weight of the carbon fiber.

9. A method according to claim 4 wherein the carbon fiber is in a form selected from the group consisting of chopped strand, continuous long fiber, woven fabric, mat, sheet and felt.

* * * * *